United States Patent [19]

Mirage

[11] Patent Number: 4,995,117

[45] Date of Patent: Feb. 26, 1991

[54] (AIRLOCK) BICYCLE HELMENT WITH ADJUSTABLE VENTILATION SYSTEMS AND ACCESSORIES

[75] Inventor: James A. Mirage, 50 W. 77 St., Dept. #10G, New York, N.Y. 10024

[73] Assignee: James A. Mirage, New York, N.Y.

[21] Appl. No.: 437,222

[22] Filed: Nov. 16, 1989

Related U.S. Application Data

[63] Continuation-in-part of Ser. No. 270,823, Nov. 4, 1988, abandoned.

[51] Int. Cl.[5] ..... A42B 1/06

[52] U.S. Cl. ..... 2/410; 2/411; 2/423; 2/425; 2/422

[58] Field of Search ..... 2/5, 6, 7, 411, 413, 2/422, 423, 424, 425, 171, 171.3, 171.4, 171.5, 184.5, 410, 421

[56] References Cited

U.S. PATENT DOCUMENTS

| | | | |
|---|---|---|---|
| 4,14,085 | 2/1979 | Adams, Sr. | 2/410 |
| 911,740 | 2/1909 | Montgomery | 2/209.7 |
| 1,774,074 | 8/1930 | Wittcoff | 2/171.7 |
| 3,797,040 | 3/1974 | Caldwell | 2/421 |
| 3,925,821 | 12/1975 | Lewicki | 2/425 |
| 4,375,702 | 3/1983 | Lundin | 2/209 |
| 4,519,099 | 5/1985 | Kamiya et al. | 2/171.3 X |
| 4,555,816 | 12/1985 | Broersma | 2/171.3 X |
| 4,612,675 | 9/1986 | Broersma | 2/171.3 X |
| 4,622,700 | 11/1986 | Sundahl | 2/425 |
| 4,639,950 | 2/1987 | Palmaer | 2/422 |
| 4,653,123 | 3/1987 | Broersma | 2/425 |
| 4,731,885 | 3/1988 | Nava | 2/171.3 X |
| 4,821,344 | 4/1989 | Kamato | 2/181.6 X |
| 4,903,350 | 2/1990 | Gentes et al. | 2/421 |

FOREIGN PATENT DOCUMENTS

| | | | |
|---|---|---|---|
| 3316920 | 11/1984 | Fed. Rep. of Germany | 2/410 |
| 3605849 | 8/1987 | Fed. Rep. of Germany | 2/410 |
| 581906 | 10/1924 | France | 2/421 |
| 2629986 | 10/1989 | France | 2/424 |
| 8603950 | 7/1986 | PCT Int'l Appl. | 2/424 |
| 666389 | 7/1988 | Switzerland | 2/423 |
| 671864 | 10/1989 | Switzerland | 2/410 |
| 14660 | of 1908 | United Kingdom | 2/171.7 |

*Primary Examiner*—Werner H. Schroeder
*Assistant Examiner*—Michael A. Neas

[57] ABSTRACT

A bicyclist helmet has a outer shell; an inner buffer liner; forward facing baffle controlled air inlets; side baffle controlled air inlets; rear discharge baffle controlled exhaust air outlets; attaching ear cups; attaching fairing cone; attachments and baffles are provided to further enhance the helmet's aerodynamic properties, as well as providing a more comfortable helmet when riding in cold or foul weather.

22 Claims, 11 Drawing Sheets

20A
17
19
18
14
20
13
15
14A
16
20A
12

12
52
51
35A
35
36
53
32
33
30
24
31
53
29
25
27
27
49
48
28
23A
23
24

(AIRLOCK) BICYCLE HELMENT WITH ADJUSTABLE VENTILATION SYSTEMS AND ACCESSORIES

This application is a continuation in part of my earlier application Ser. No. 270,823 filed on Nov. 14, 1988, now abandoned.

BACKGROUND OF THE INVENTION

The background of the invention has taken many forms in the past. Some have been as simple as for ventilating an ordinary felt hat, as in Pullens, British Pat. No. 14,660 or Witcoff U.S. Pat. No. 1,774,074. Others have skimmed around the concept in various ways and some have employed the concept in somewhat limited capacity, given the governing requirements and the use in which the concept of placing baffles or other forms for opening or closing the vents holes in head gear is employed for example Broersma U.S. Pat. No. 4,612,675 and Kamata U.S. Pat. No. 4,821,344 as well as Kamiya, et al, U.S. Pat. No. 4,519,099. The advantages of my helmet is that it takes full advantage of the use of movable baffles to control the inside climate when air enters the helmet, and at the same time making a more sleek and aerodynamic helmet for bicycling while at the same time providing all the advantages of a conventional helmet.

SUMMARY OF THE INVENTION

It is an objective of the invention to provide total air control within the helmet and to better regulate the climate within the helmet while at the same time providing a more aerodynamic helmet. The helmet in its most basic concept consists of a thin outer dome structure with an inner buffer liner. There is a Chin strap system to retain the helmet on the wearer's head. The helmet has front baffle controlled ventilation passages as well as side ventilation passages which are also baffle controlled. Both front and side vents take in forced cooling air which travels through the helmet and exits through the rear exhaust ventilation openings. The rear vent openings, like the front and the side vents are baffle controlled Having baffles on all the openings of the helmet allows the wearer full control of the amount of air that enters through the front and the side vent openings. By being able to control the size the vent apertures can be opened to, not only gives the wearer the advantage of sealing out the elements when it is desired, but it also makes the helmet more aerodynamic. To further enhance the aerodynamic properties of the helmet, as well as the comfort advantages when protecting the wearer against the elements, the helmet is equipped with attachments which snap on and off the helmet. The helmet is made to receive ear cups which attach to the sides of the helmet, these ear cups help, not only to keep the ears warm in cold weather, but they also help to make the helmet more sleek around that part of the head, hence making the helmet more aerodynamic. To further add to the aerodynamic properties of the helmet, a fairing cone is attached to the rear of the helmet for the sole purpose of making the helmet more aerodynamic. This is achieved by attaching an elongated cone to the rear of the helmet, the fairing cone helps to cut down the wind drag that is produced by the helmet when it is worn while riding on a bicycle going at high speeds

DRAWING DESCRIPTION

DETAILED DESCRIPTION

Figure 1:
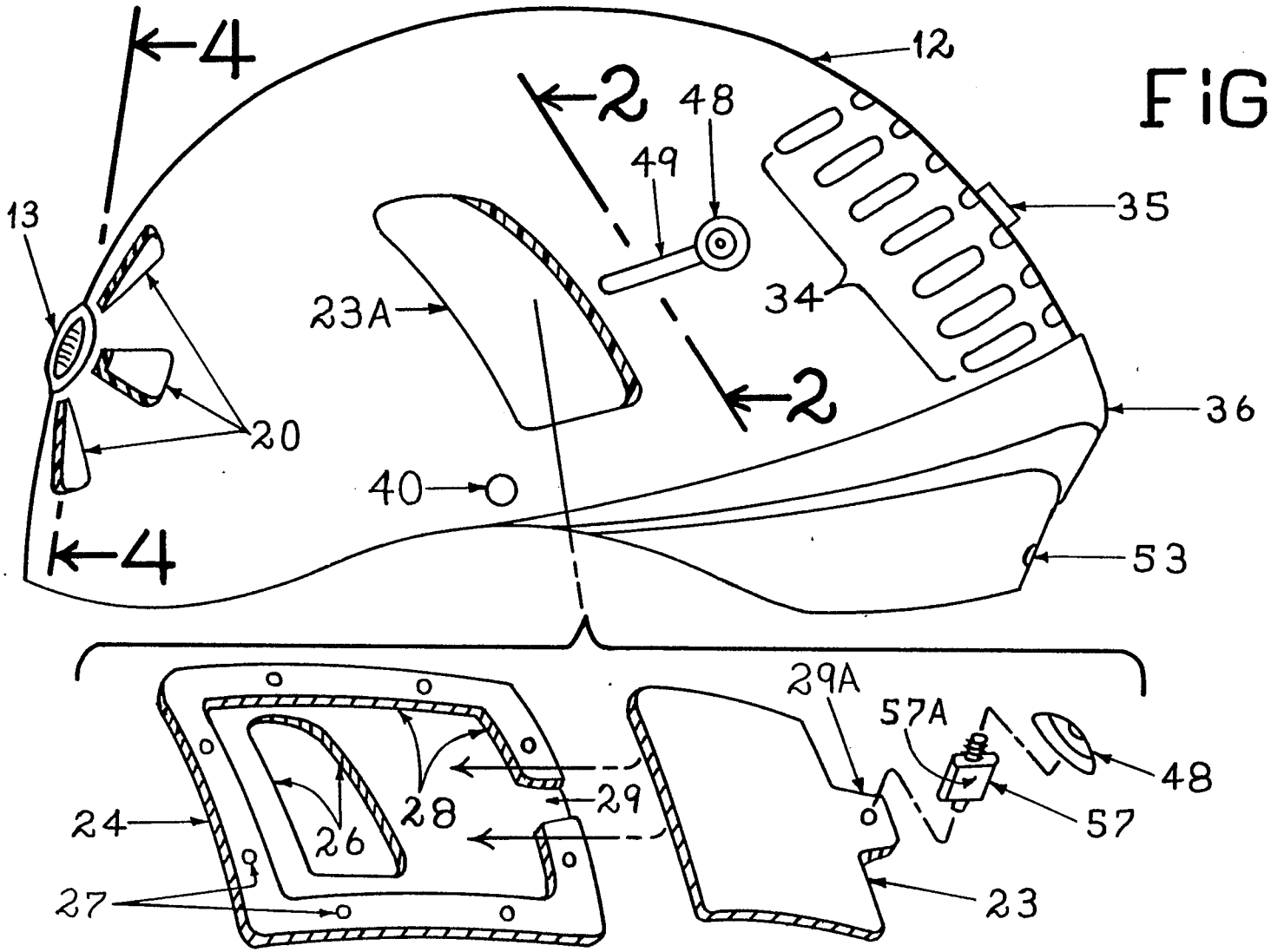
FIG. 1 is a side view of a helmet with an exploded view of the parts of the side vent assembly.
Figure 2:
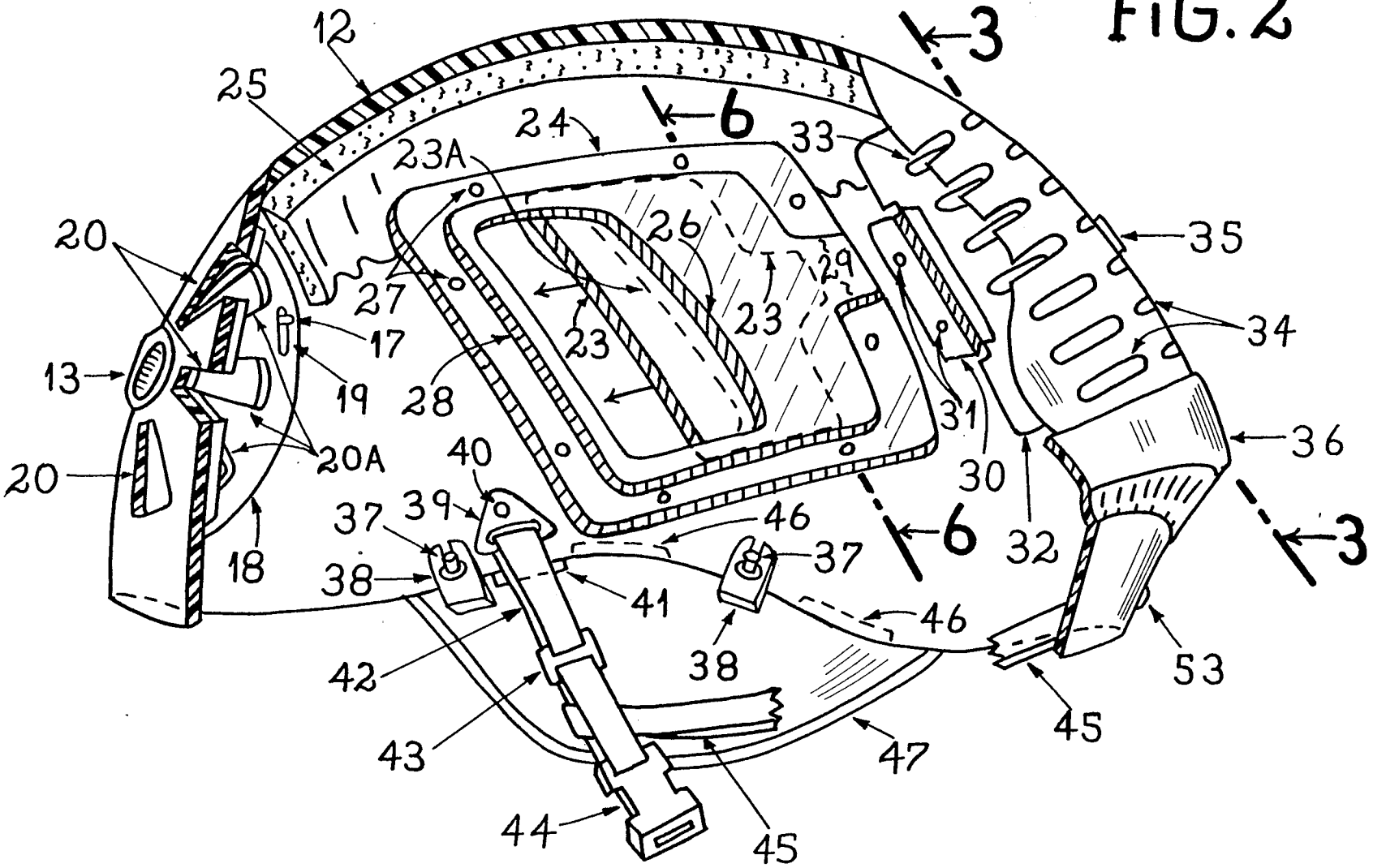
FIG. 2 is a view of a helmet with the left wall cut-away to expose the internal working parts.
Figure 3:
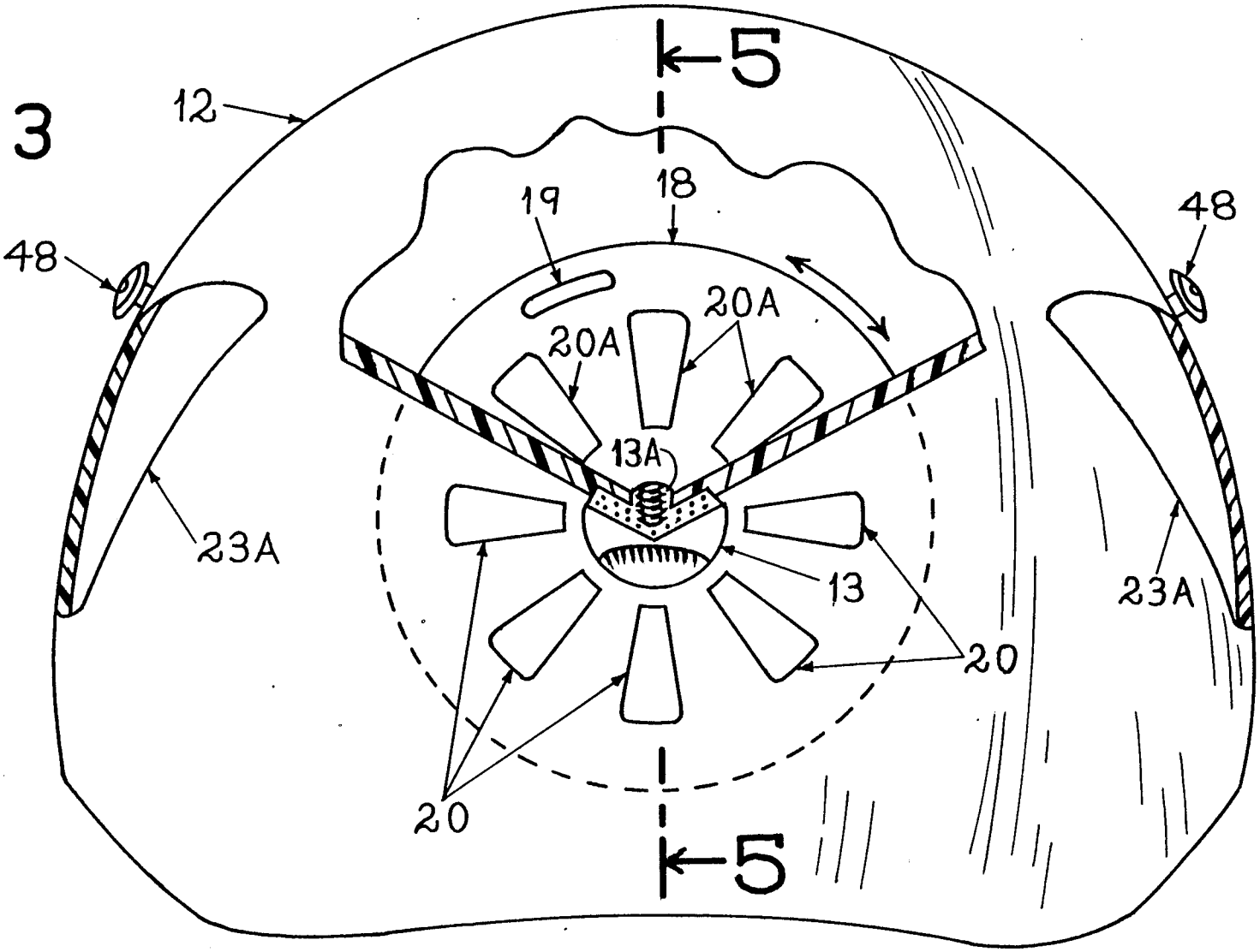
FIG. 3 is a front view of a helmet with partial section removed indicating line 4—4 of FIG. 1.
Figure 4:
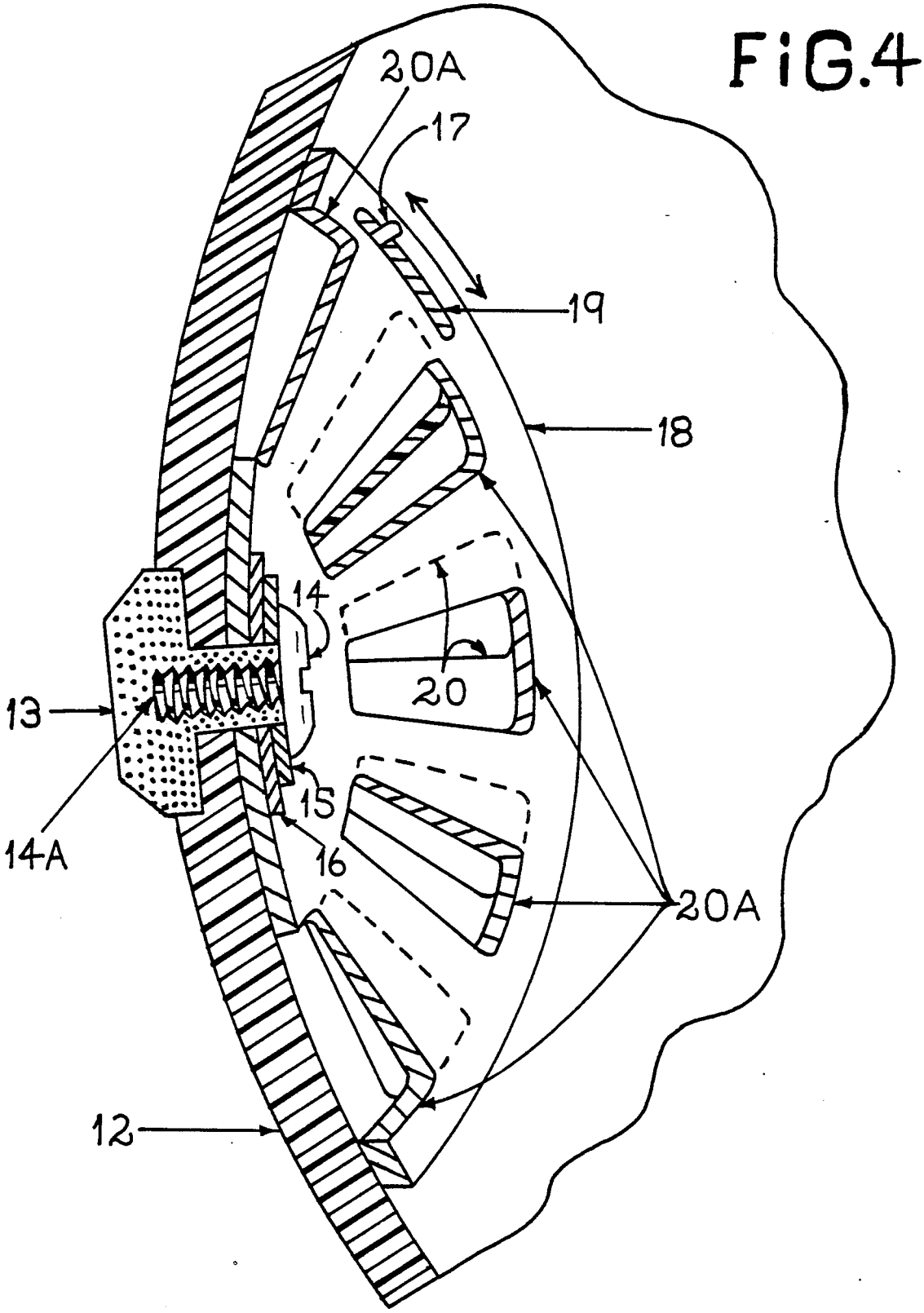
FIG. 4 is a detail of line 5—5 of FIG. 3.
Figure 5:
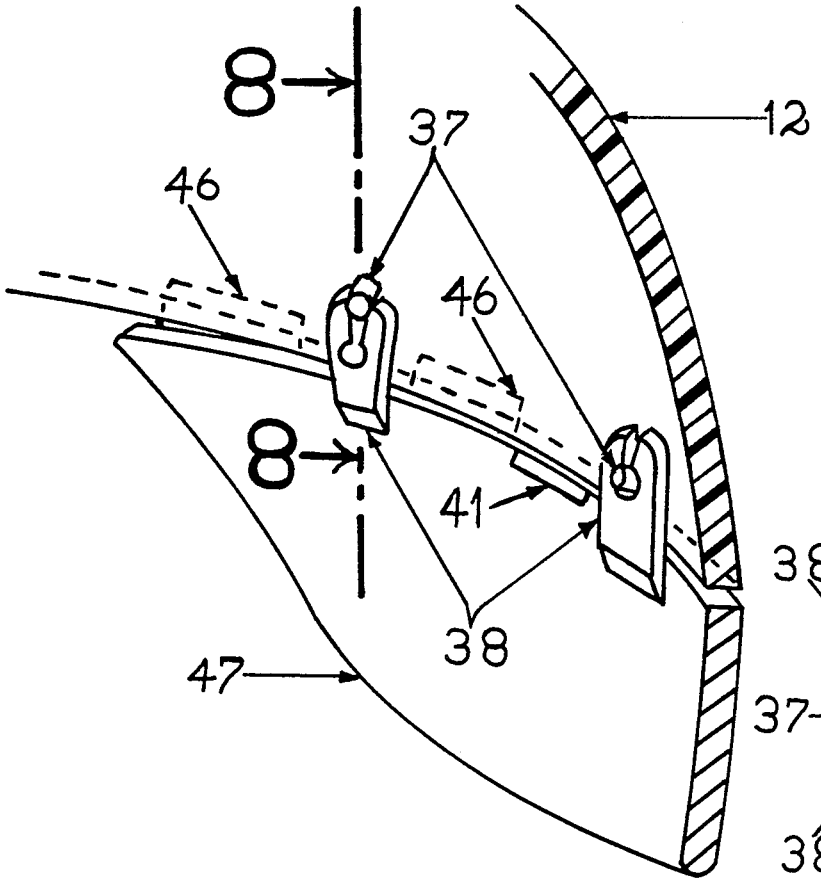
FIG. 5 is an elevated view of the ear cup #47 partially cut-away showing how it locks onto the helmet shell.
Figure 6:
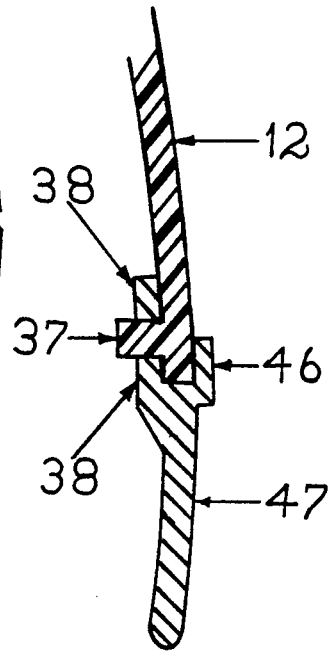
FIG. 6 is a detail along line 8—8 of FIG. 5.
Figure 7:
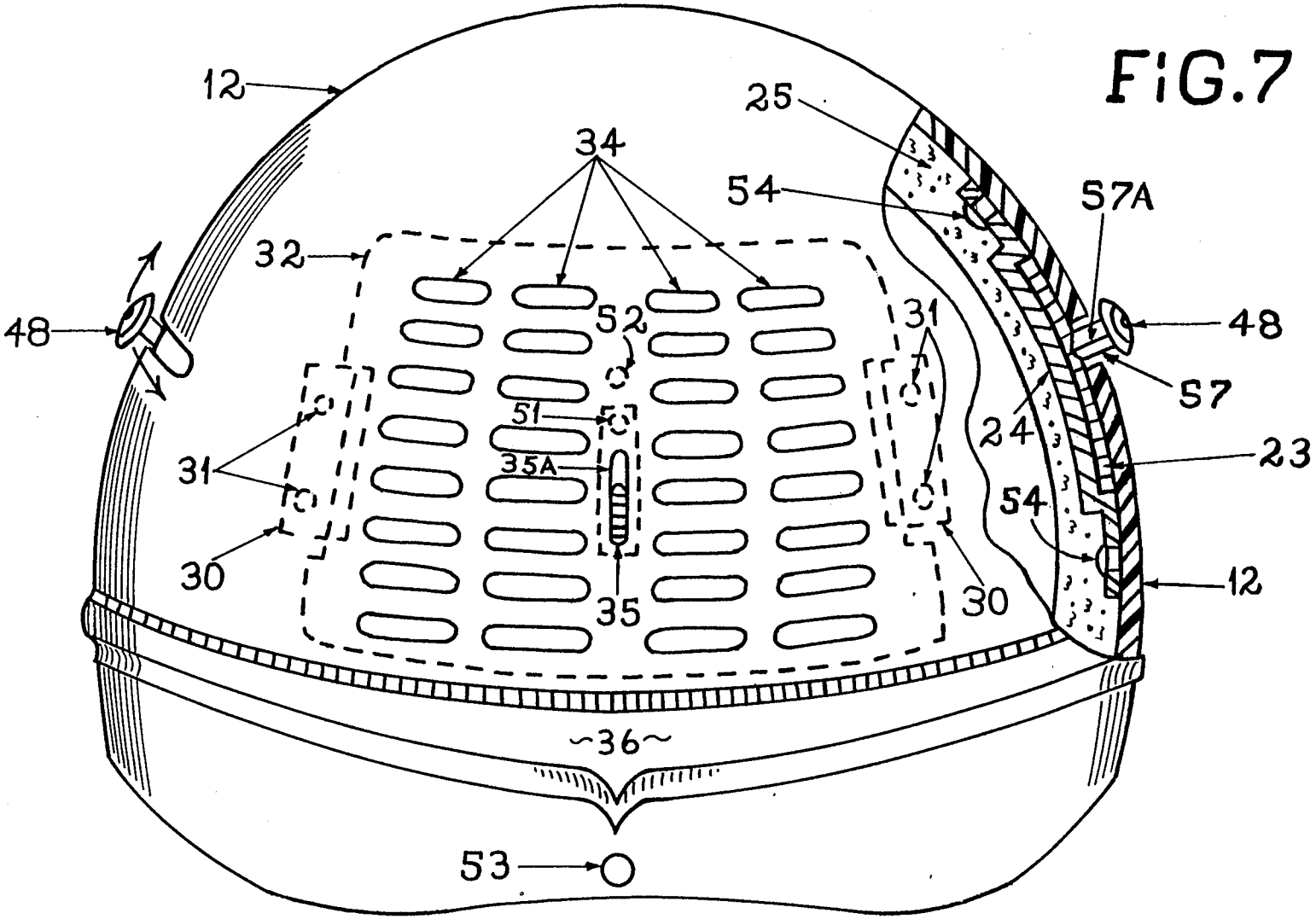
FIG. 7 is a cut-away view of the rear of a helmet highlighting along line 6—6 of FIG. 2.
Figure 8:
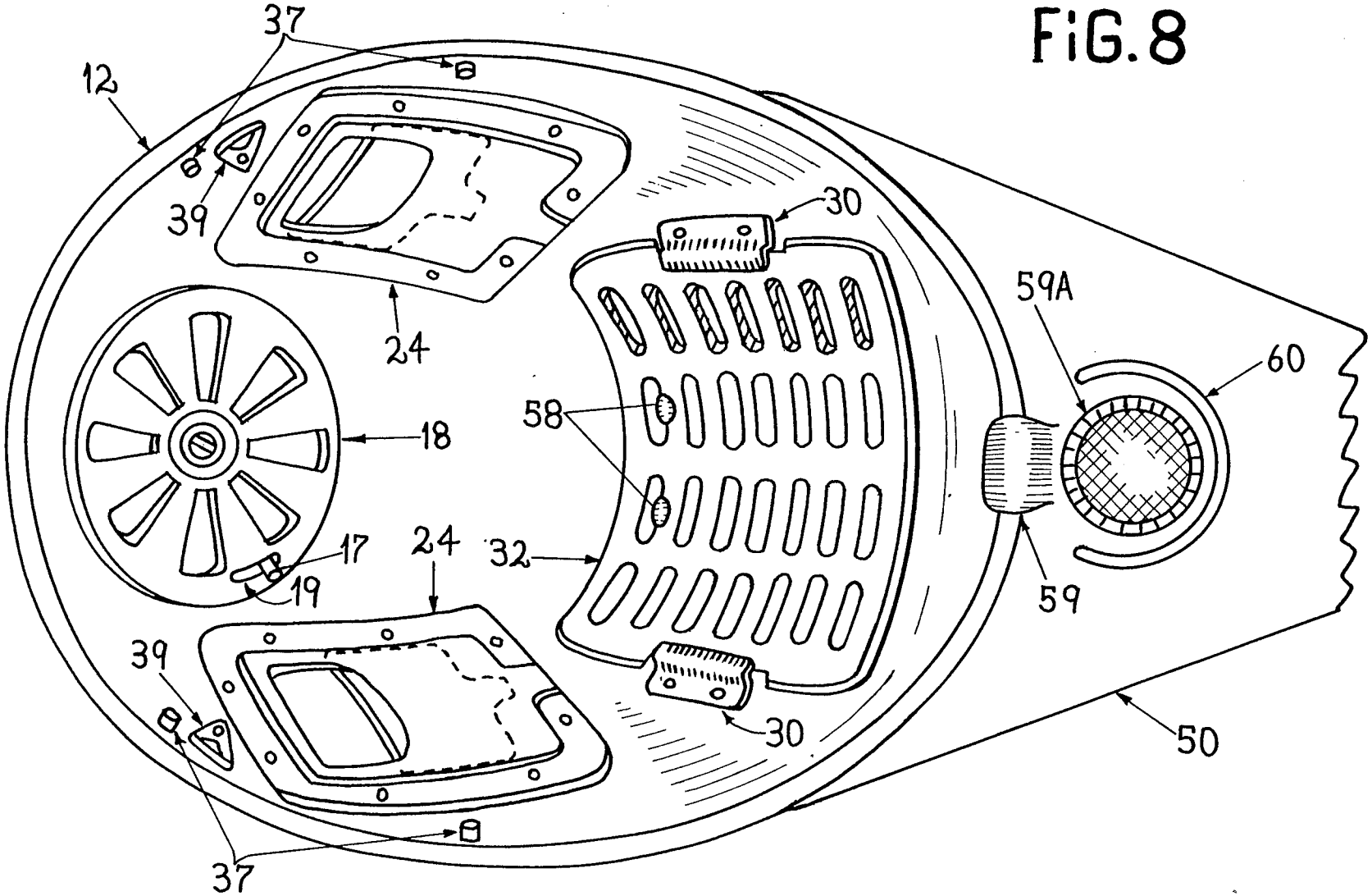
FIG. 8 is a bottom view of a helmet showing the internal working parts.
Figure 9:
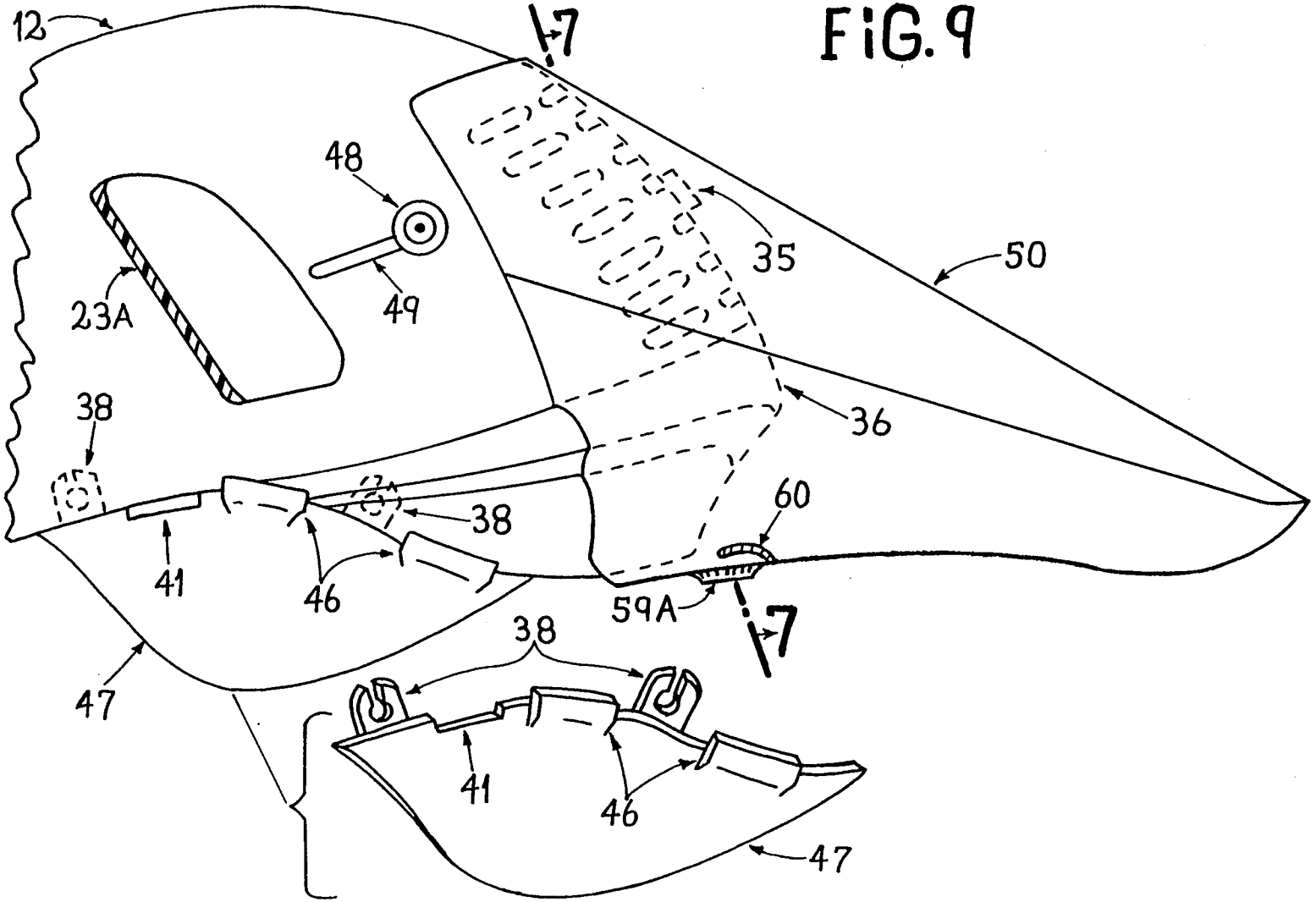
FIG. 9 is a partial view of the side of a helmet showing the attachment parts and how they relate to the helmet.
Figure 10:
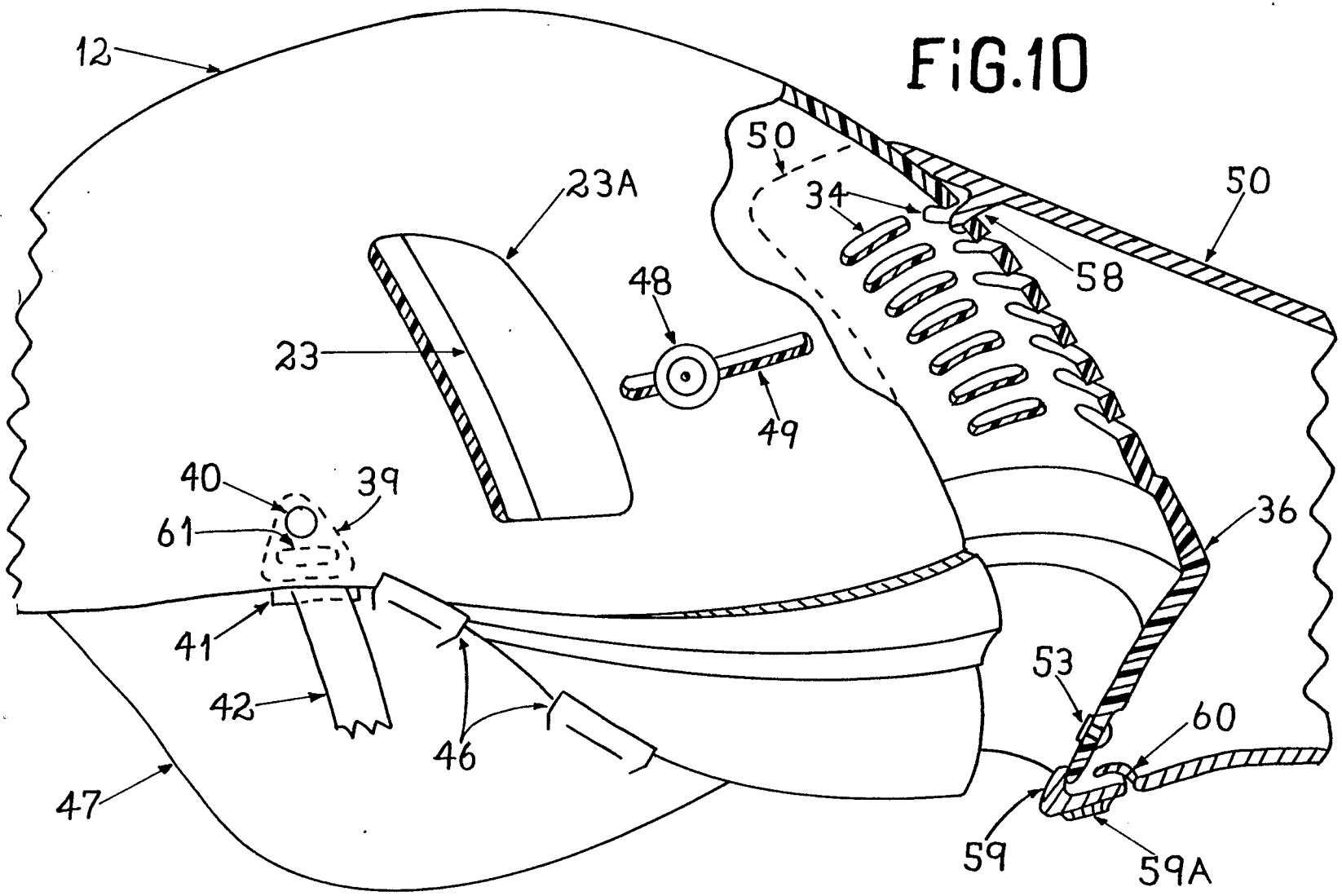
FIG. 10 is a cut-away view of a helmet highlighting along line 7—7 of FIG. 9.
Figure 11:
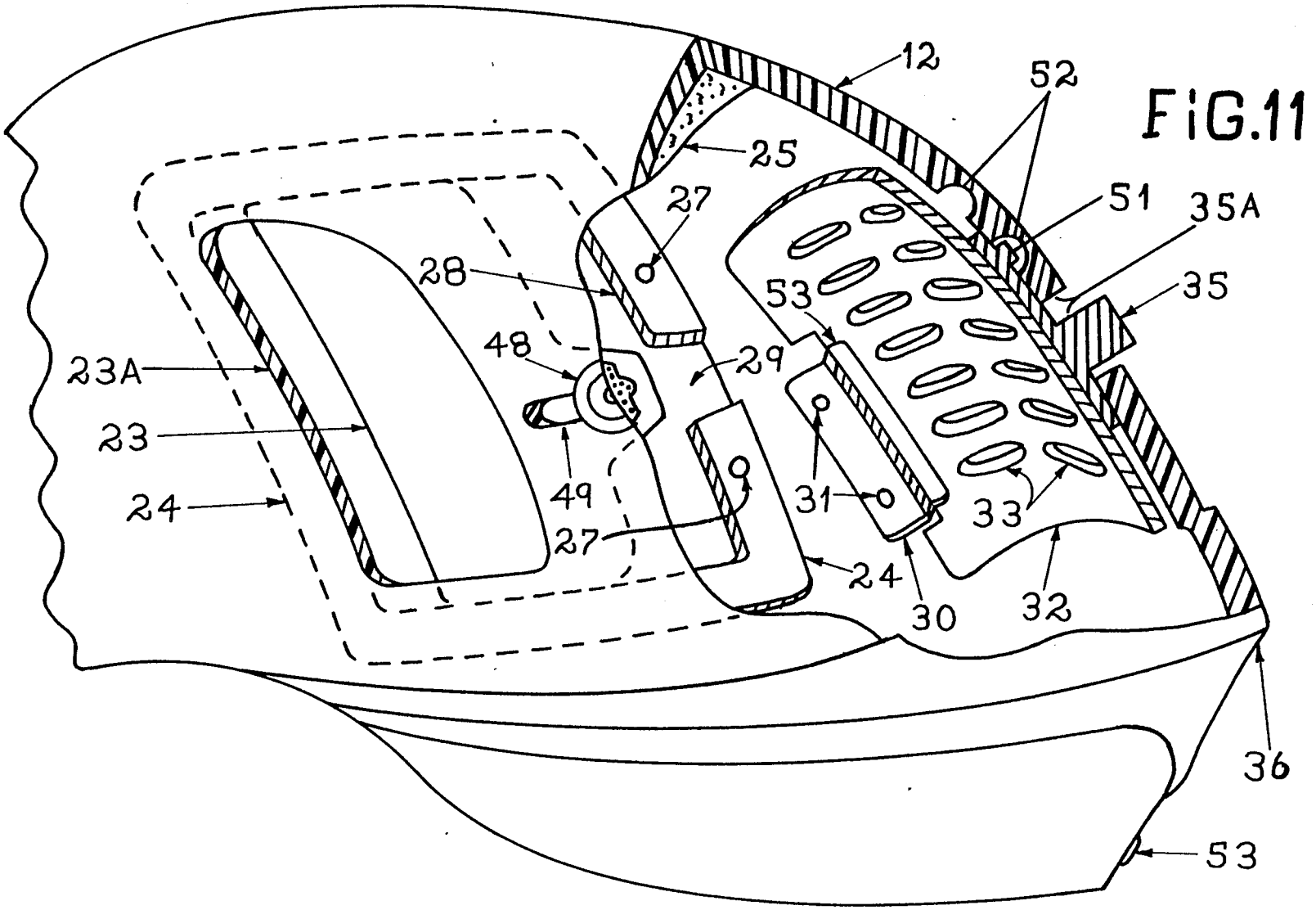
FIG. 11 is a cut-away view of a helmet highlighting along line 3—3 of FIG. 2.
Figure 12:
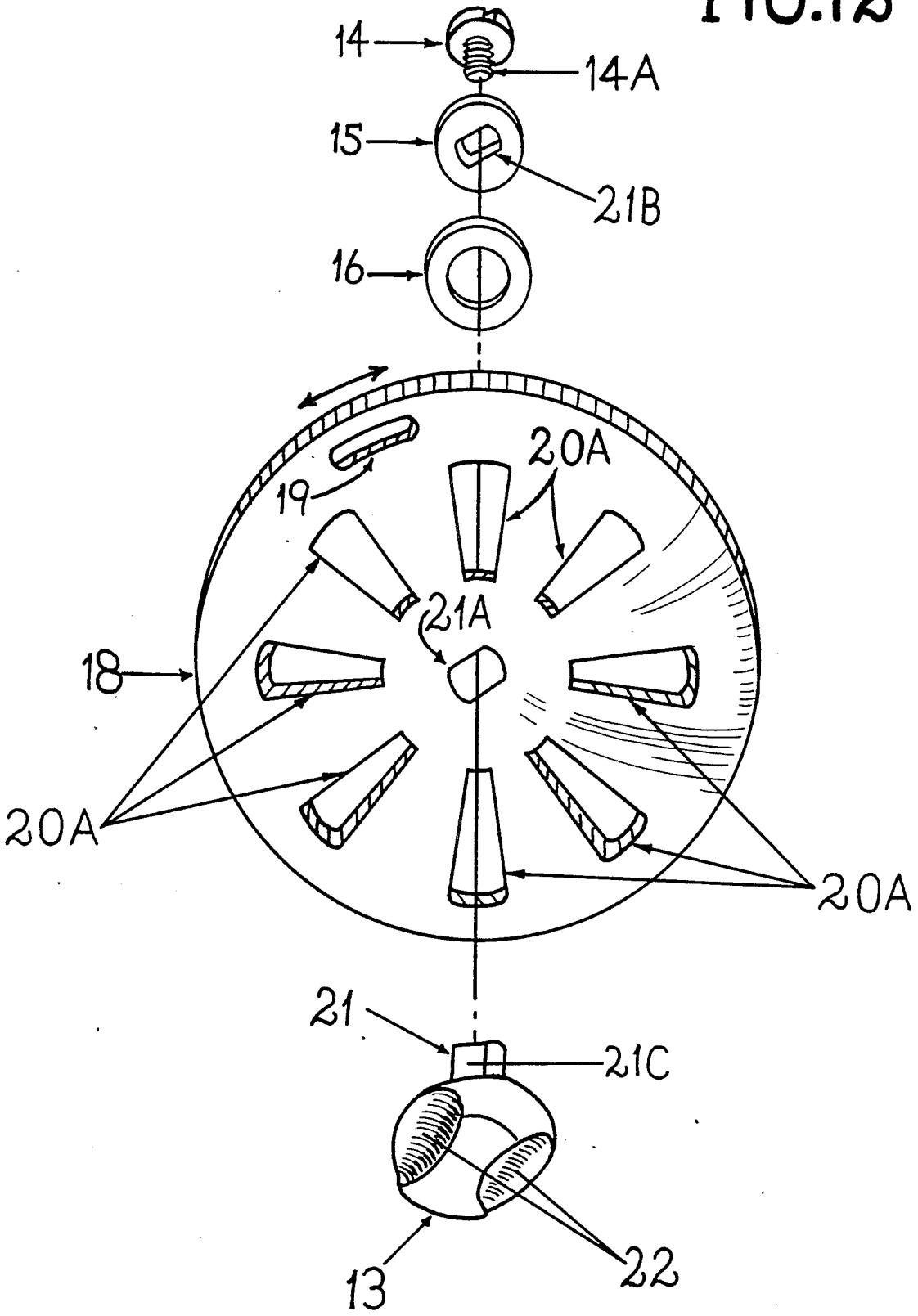
FIG. 12 is an exploded view of the moving parts of FIG. 4.

FIGS. 1, 2, 3, 7, 8, 9, 10, 11 show the helmet 12 which is intended for use by a bicyclist. It is dome-shaped with thin outer walls which can be made of plastic or a combination of fiber and resin. The helmet is equipped with a buffer liner 25. The helmet is rearwardly elongated 36 to enhance the aerodynamic properties of the helmet. The helmet is equipped with a chin strap system 42, 43, 44, 45 of which half of it can be seen in FIG. 2. As Viewed in FIG. 10, part 53 is a rivet that retains the back strap 45 of the chin strap which serves to keep the chin strap from sliding forward on the wearer's head. FIGS. 2, 8, 10, all show part 39. Part 39 retains the chin strap on the helmet. Part 39 is held onto the helmet by a rivet 40 on the left and on the right side of the helmet. There is an oblong hole 61 in part 39 where the chin strap passes through to retain it to the helmet. In FIG. 2 the front of the helmet is provided with centered and forwardly-facing ventilation openings 20 which are arranged in a daisy-like pattern to help distribute cooling air entering the helmet, for a more uniform distribution of air to that area of the wearer's head. Two side vent openings 23A are situated to the left and to the right of the helmet and slightly facing forward. They are provided to further aid in the cooling system and to help pass air more freely through the inside of the helmet. At the rear of the helmet there are exhaust ventilation openings 34 arranged in a louver pattern for the purpose of extracting the forced cooling air that enters through the front and side vent openings. The front ventilation openings 20 as illustrated in FIGS. 1, 2, 3, 4, 8, 12 are provided with an internal baffle system which is intended to control the amount of air entering the front vent openings. This is achieved by placing a movable baffle 18 directly over the front ventilation holes and on the inside of the helmet. The holes in the baffle match perfectly the holes on the helmet shell. The baffle is pivotally arranged and held to the helmet by a centralized nut and bolt system with its outer most component visible at the front of the helmet as shown in FIGS. 1, 2, 3, 4 at the center of the daisy patterned vent hole openings. There is a front vent control knob 13 which serves as an actuating knob with two landings 22 shown in FIG. 12. These landings are provided to accommodate the user with two convenient surfaces on which the thumb and the index fingers rest, to more easily turn the baffle inside the helmet. At the opposite end of the control nob is the female treaded end 21 which serves as a threaded nut. This portion of the control nob protrudes into the helmet at the center of the daisy pattern through a hole 13A. As shown in FIG. 3, section 21 is similar in dimensions to a central hole 21A in the baffle, see FIG. 12. This part of the control nob has two flat surfaces 21C which engage the baffle central hole, allowing for a positive grip of the baffle when turning the baffle. As part 21 passes through the baffle, it engages a round washer 16 and a slotted washer 15. Both of these washers are provided to lend greater stability to the connection of the control knob and the baffle. Finally the control knob screws into a screw 14 which at its threaded end 14A threads into the control knob. The screw holds the system of the front vent together by sandwiching the helmet between the screw 14 and the control knob 13 including the baffle and the two washers. The ventilation holes 20 as illustrated in FIGS. 1, 2, 3, 4 match the holes on the baffle 20A. When the control knob is turned the holes on the helmet are no longer aligned with the holes on the baffle, and when this is done, the holes of the helmet shell are now blocked by the baffle and no air can enter into the helmet by these passageways. This is advantageous to the wearer if he or she desires to make the helmet more aerodynamic or to keep cold air and rain out, when riding in cold or fowl weather A slot 19 on the baffle, see FIG. 2 3, 4, 8, 12, fits directly onto a post 17 which is an extension of and an integral part of the helmet and is situated on the inside wall at the front of the helmet shell. The slot and the post work together to restrict the distance the baffle will travel as illustrated in FIG. 4 depending in which direction the baffle is turned. This post and slot determine whether the front vent holes are fully opened or closed. The post and slot operate as a stop mechanism to limit the distance the baffle will turn. The side ventilation openings 23A of the helmet, as illustrated in FIGS. 1, 2, 7, 8, 11, employ sliding movable baffles 23. The side baffles are held in place on the inside of the helmet on the left and on the right side, by templates 24 which are permanently attached to the inside of the helmet. These templates have single perforations 27 along their perimeter and they are matched to rivets 54 which are an extension of and an integral part of the helmet shell. These rivets are located around the side vent openings on the inside of the helmet. The rivets are spaced at equal intervals to match the holes on the templates. The rivets are used to locate the templates in their proper place on the helmet, as illustrated in FIG. 2, and 7. Once the template is located on the helmet, the rivets are heated and mashed down, thereby locking the template onto the helmet The templates are now directly over each side vent opening on the inside of the helmet shell. Each template has a similar opening 26 at its forward half that matches the openings of the side vents on the helmet. The openings on the helmet and the openings on the templates are of similar dimensions and are aligned, one directly over the other so that air enters through the side vents and straight through the templates and onto the wearer head. The templates have a central portion that is slightly depressed. This depression 28, as shown in FIG. 1, serves as a channel in which the baffle slides back and forth in the helmet as it is sandwiched between the inside of the helmet over the side vents and the templates. The central depression of the templates are approximately the same depth as the thickness of the baffle. The length of the baffle is equal to the width of the template central depression which makes it impossible for the baffle to move in a vertical direction. The length of the template depression is twice that of the width of the baffle. This fact allows the baffle to slide back and forth freely as it is held between the template and the helmet. The rear part of the baffle 29A is tapered to fit a similar tapering 29 at the rear of the template depression. By tapering the baffle and the template in this manner, it helps to guide the baffle as it approaches its rearward travel in the helmet. This tapering on the baffle also serves as a platform for the post 57 that is attached to the baffle with adhesive. This post protrudes to the outside of the helmet through a slot 49 that is located on the helmet just behind and at the center of the side vent openings. The post has two flat surfaces 57A. The width between these two flat surfaces is equal to the width of the slots on the helmet. This helps to guide the post back and forth in the slot with a minimal of lateral motion, and therefore, lending greater stability to the baffle. The slot in the helmet, as it extends to the rear of the helmet, is the same length as the width of the baffle. The post is threaded at the end that protrudes to the outside of the helmet, which is then screwed into an actuating knob 48. When this knob is pushed forward, it in turn pushes on the baffle, and thereby closing the side vent opening with the baffle. When the nob is pushed to the rear of the helmet the baffle is now opened. Each baffle works independently of the other, and therefore, one can be opened while the other is closed. The baffles can also be partially opened or closed if it is so desired. FIGS. 1, 2, 7, 8, 11, all show the rear vents. FIG. 11, shows the rear vents in detail. In FIG. 1 the helmet appears from the side view. The holes Of the rear vent are arranged in a louver pattern with four rows of oblong holes 34, running horizontally in the helmet. The louver holes are arranged one above the other, as it is shown in FIG. 7. The purpose of the rear vent is to draw out the air that is forced into the helmet through the front and the side vent openings. The rear ventilation system, like the other vents has a movable baffle, but unlike the other vents the rear vent baffle 32 moves in a vertical direction in the helmet. The rear vent baffle has a plurality of holes arranged to match the holes at the rear of the helmet. The baffle which fits directly over the rear vent holes and on the inside of the helmet is held into place on the inside of the helmet at the rear by two templates 30. There is one template on the right and one template on the left of the baffle. Each template is fastened permanently to the inside of the helmet by two rivets 31 which are an extension of, and an integral part of the helmet. The templates are placed up close to the sides of the baffle so that the baffle will not move from right to left. Each template rises up the side walls of the baffle and then curves into the baffle and overlaps the baffle for about half an inch. This allows the baffle to remain in place on the inside of the helmet, yet, at the same time allowing the baffle to move freely up and down inside the helmet. Attached to the rear of the baffle is the actuating knob 35, which is an extension of, and an integral part with a detent spur 51. When part 35/51 (Which is one piece) is placed in its proper place at the center of the baffle, it lays sandwiched between the baffle and the helmet. The actuating knob 35, then protrudes from .the inside of the helmet to the outside through a hole 35A. This hole is located at the rear of the helmet, and at the center of the four rows of the louver holes. Hole 35A is slotted and vertically located on the helmet. This slotted hole allows the actuating knob to slide up and down in the helmet. The distance the actuating knob is allowed to move in the slot is approximately the same distance of the width of the louver holes. Therefore, when the actuating knob is pushed up on the helmet, the baffle moves up with it, and by so doing, it closes the rear vents by blocking the louver holes with the baffle. The rear vent system employs a detent system which consists of two detent depressions 52 on the inside and at the center of the helmet. These detent depressions are arranged one above the other. The second part of the detent system is the spur 51. As it was mentioned before, the spur is an extension of and an integral part with the actuating knob. The reason for this detent system on the rear vents is to lock the baffle into its opened or closed position. This locking system is necessary on the rear baffle because the motion of the baffle is vertical and this means that when the helmet is worn and the wearer is riding his or her bicycle, the jarring created by a rough road will cause the baffle to move on its own To prevent this from happening, the spur which is now attached to the baffle with adhesive will fit into one of the detent depressions in the helmet and thereby keep the baffle locked into one position at a time. When it is desired by the wearer, he or she can push the actuating knob into the helmet to disengage the spur from the detent depression and the baffle is now free to slide up or down where it then can engage the next detent depression and by pushing the actuating knob in and then sliding it up the baffle will now block the vent holes and the rear exhaust vent is now closed. When the rear exhaust vent is desired to be in the open position, simply push the actuating knob into the helmet. By sliding the actuating knob down, the baffle will slide down with it and, therefore, re-opening the rear vent, as well as locking the baffle into place with the spur fitted into the lower detent depression. FIGS. 2, 5, 6, 9, 10, show the ear cups 47. The purpose of the ear cups is to provide a covering for each ear of the wearer. This is advantageous to the wearer when a more aerodynamic helmet is desired or when riding in cold weather. In FIG. 2, one ear cup can be seen from the inside as it attaches to the helmet. In FIG. 10, the ear cup of the right ear is shown attached as it is viewed from the outside of the helmet. In FIG. 9, the ear cup of the right ear is shown as it is attached to the helmet as well as what it looks like when it is detached from the helmet. FIG. 5 shows an ear cup and a wall of the helmet as an inside view and partially cut away. As can be seen in FIG. 5, the helmet has two straight post 37 on each side of the helmet. These posts protrude into the helmet and are an extension of and an integral part of the helmet. These posts lock onto a pair of tabs 38 that are set on each ear cup. These tabs extend from the upper rim of the ear cups and they reach up into the helmet just far enough to slide onto the two Posts on each side of the helmet. Each tab is split down the middle and at the end of the split they open out into a hole. These holes are approximately the same width as the post on the helmet. When the tabs of the ear cups are aligned to the Post on the helmet, the ear cups are then pushed up, thus forcing the tabs to part at each split. As one continues to push up, each post snaps into each hole of the tabs and now the tabs and the post are mated together and the ear cups are secured onto the helmet. The ear cups employ two tabs 46 on its outer surface. These tabs are of plain design with no holes. These tabs extend above the upper rim of the ear cups so that they overlap the helmet on the outside when the ear cups are on the helmet. These two tabs serve to create Pressure on the outside of the helmet and, thereby, allow the ear cups to remain on the helmet more securely as it can clearly be seen in FIG. 6. FIG. 6 is a cutaway view of line 8—8 of FIG. 5. Each ear cup has a slit 41 cut on its upper edge so that the chin strap can pass through to the outside of the helmet and not interfere with the snug fit of the ear cups on the wearer's head. The rear fairing cone 50 as seen in FIGS. 8, 9, 10, is a device which attaches to the rear of the helmet on the outside. The fairing cone serves to enhance the aerodynamic properties of the helmet by allowing for a more streamlined shape at the rear of the helmet shell. The fairing cone helps to reduce wind drag at the rear of the helmet when the wearer is moving forward on the bicycle. FIG. 9 shows a partial side view of the helmet with the fairing cone attached at the rear of the helmet shell FIG. 10 shows a detail of line 7—7 of FIG. 9 and it is cutaway to show a side view of how the fairing cone locks onto the rear of the helmet. As can be seen in FIG. 9, the rear fairing cone employs a hook system consisting of three hooks that lock onto the rear of the helmet and for this purpose there are two hooks 58 at the top and on the inside of the fairing cone. These two hooks slide into the two topmost and centered of the louVer holes in the helmet. Once the two top hooks of the fairing cone are pushed into the helmet, they catch onto the lower lip of the louver holes. A third hook 59 is located at the bottom of the fairing cone and this third hook clasps onto the lower rim of the helmet at the center and bottom edge of the helmet at the rear. Just behind the bottom hook and to the rear of the fairing cone there is a button shaped actuating knob 59A. The bottom hook and the actuating knob which are illustrated in FIG. 10 can also be seen in FIG. 8. FIG. 8 further makes clear how the three hooks work to lock the fairing cone onto the helmet. FIG. 8 shows the ends of the two top hooks 58 protruding into the helmet at the top most center louver holes. There you will see how they catch onto the helmet shell The lower hook, which can be seen wrapped around the lower edge of the helmet in FIG. 10, can also be seen from a bottom view in FIG. 8. In FIG. 8, 9, 10, as illustrated, there can be seen a cut 60 on the rear fairing cone. This cut travels more than half way around the button shaped actuating nob. This cut compromises the integrity of the wall around the actuating nob, and by so doing allows the nob to be depressed into the fairing cone. When this is done, the lower hook on the fairing cone is forced to move down and away from the helmet. When it has traveled far enough, the lower hook clears the bottom of the helmet's edge and now the fairing cone can be pulled out and up so that it can be removed from the rear of the helmet.

I claim:

1. A helmet comprising an outer helmet shell and a buffer liner attached to the inner surface of said outer helmet shell, said helmet further comprising, (a) front-facing ventilation openings arranged in a circular, daisie-like pattern, at a front of said outer helmet shell, as a means for ventilation, (b) and singular vent openings on a left and a right side, of said outer helmet shell, (c) and rearward facing exhaust openings comprising a plurality of apertures arranged in a louver-like pattern, at a rear of said outer helmet shell, (d) chin straps attached to said helmet at the sides and at the rear of said outer helmet shell for the purpose of maintaining said helmet on a wearer's head, (e) said liner being provided with openings corresponding to the openings of said outer helmet shell for ease of airflow to a wearer's head.

2. A helmet according to claim 1, further including an inner movable baffle with a plurality of openings.

3. The helmet of claim 2, wherein said baffle is attached to said shell by a centralized nut and bolt system allowing for a partial rotation of said baffle being attached to the inner surface of said outer helmet shell and directly over the front-facing vent openings.

4. The helmet according to claim 2, wherein said baffle an elongated hole to accommodate faceted portions of a control knob, said facets being equal in proportion to a center hole in said baffle for means of rotating the baffle.

5. A helmet according to claim 2, further including a post constituting an extension of and being an integral part of the inside of the outer helmet shell, said post fitting into a slot adjacent to a peripheral edge of said baffle, and constituting means for restricting a distance the baffle will travel.

6. A helmet according to claim 1, wherein said singular ventilation openings on the left and right side of said helmet, being placed slightly facing forward, are covered by forwardly and rearwardly sliding baffles.

7. A helmet according to claim 6, wherein said sliding baffles are located on the inside of the outer helmet shell, each of said baffles being held to the inside of the outer helmet shell by a template permanently attached to the inside of the outer helmet shell, and said template being located directly over and on the inside of each of the side vent openings and each template having openings corresponding in size, shape and location to the openings on each of the side vent openings.

8. A helmet according to claim 7, wherein said templates have a central depression protruding inwardly away from the inner walls of said outer helmet shell, said central depression forming controlled passageways, the length of the baffle and the width of the template depression are of equal proportions thereby restricting said baffle from moving in a vertical direction.

9. A helmet according to claim 8, wherein the thickness of said baffle and the depth of said depression of said template are of equal proportions, the length of said depression on the template is twice the width of the baffle, therefore allowing said baffle to slide rearwardly on said helmet, and allowing the openings in the right side of and the left side of said outer helmet shell to be opened without obstruction.

10. A helmet according to claim 9 further comprising a slot on each side of said outer helmet shell, said slot being located just behind each said side ventilation opening and originating behind said vent openings and elongated towards the rear of said outer helmet shell, said slots being equal in length to the width of said baffles.

11. A helmet according to claim 10, wherein said baffle is attached to a post, one end of said post protruding through said slot at the rear of the side vent openings, said post having a screw threaded end passing to the outside of the outer helmet shell and connected onto an actuating knob, said knob being manipulated by the wearer to slide the baffle forward and rearward to open and close the side vent openings.

12. A helmet according to claim 1, wherein said plurality of holes arranged in a louver-like pattern at the rear of said helmet shell constitute means for exhausting air entering the front and side vent openings.

13. A helmet according to claim 12, further including an inner movable rear baffle located directly over the rear louver-like openings of said helmet and on the inside of said outer helmet shell, said baffle having matching openings corresponding to the louver-like openings at the rear of said outer helmet shell, and said baffle having means for moving the same up or down in a vertical direction.

14. A helmet according to claim 13, further comprising two templates permanently attached to the rear inside wall of the outer helmet shell, said templates being located to the left and to the right of said rear baffle and are slightly overlapping said rear baffle and thereby attaching said rear baffle to said outer helmet shell without restricting vertical movement of the rear baffle.

15. A helmet according to claim 14, further comprising a detent system at the rear inside wall of said outer helmet shell, said system including two detent depressions in said outer helmet shell, both said detent depressions being located one above the other, the said detent system further includes a raised spur and an actuating knob, said spur being an extension of, and an integral, part of the said actuating knob, the spur and actuating knob are permanently adhered to the center of rear said baffle on the baffle's outer most surface, said rear exhaust openings further include a slit at a center of the rear louver-like openings with said actuating knob extending through said slit to the outside of said outer helmet shell.

16. A helmet according to claim 1, further comprising ear cups removably attached to said helmet, said ear cups having a system for retention to the helmet, said system including two tabs split down the middle, the split meeting with a hole at a center of each tab, and said tabs on said ear cups engaging two pegs on each side of the said outer helmet shell to lock the ear cups into place.

17. A helmet according to claim 16, wherein the ear cups have two additional facets each at an outside of each ear cup, said facets engaging a lower outside edge of said outer helmet shell.

18. A helmet according to claim 1, further comprising a conical-shaped fairing attached to the rear of said outer helmet shell, said fairing providing aerodynamic advantages.

19. A helmet according to claim 18, wherein said fairing has a hooking system with multiple hooks engaging the outer helmet shell at three places at the rear of said outer helmet shell, two hooks engaging the helmet at the two upper most, and central louver-like openings, a third bottom hook engaging the helmet at a lower edge of said outer helmet shell.

20. A helmet according to claim 19, wherein said bottom hook has means for wrapping around the bottom edge of the outer helmet shell and curving slightly inwardly into the helmet, and constituting an extension of and being one piece with a bottom wall of said fairing.

21. A helmet according to claim 20, having on said fairing and slightly to the rear of the bottom hook a raised surface resembling a button being also an extension of, and being one piece with the bottom outside wall of the fairing cone, said button when pressed inwardly into the fairing acts as a lever to move said bottom hook away from the helmet and disengaging the fairing from the helmet.

22. A helmet according to claim 21, and further including a semicircular cut in the wall of said fairing and surrounding said actuating button and thereby allowing said button free motion when depressed into the fairing and by so doing disengaging the bottom hook from said outer helmet.

* * * * *